US005553404A

United States Patent [19]

Bergeron

[11] Patent Number: 5,553,404

[45] Date of Patent: Sep. 10, 1996

[54] POWER BUCKET

[76] Inventor: Raymond C. Bergeron, 3452 W. Jefferson, Trenton, Mich. 48183

[21] Appl. No.: 420,223

[22] Filed: Apr. 11, 1995

Related U.S. Application Data

[63] Continuation-in-part of Ser. No. 245,240, May 17, 1994, Pat. No. 5,501,024.

[51] Int. Cl.[6] ..... B66C 3/02

[52] U.S. Cl. ..... 37/184; 294/68.23; 294/66.1; 37/340; 37/341

[58] Field of Search ..... 294/68, 23, 66.1, 294/66.2; 37/461, 184, 340, 341, 901, 338

[56] References Cited

U.S. PATENT DOCUMENTS

| | | | |
|---|---|---|---|
| 1,864,793 | 6/1932 | Botten | 37/184 |
| 2,744,640 | 5/1956 | Somers | 37/184 |
| 2,828,038 | 3/1958 | Dorkins | 37/901 |
| 2,997,797 | 4/1961 | Frankum . | |
| 3,675,348 | 7/1972 | Dane | 37/338 |
| 3,722,448 | 3/1973 | Leonardi | 37/186 |
| 3,762,078 | 10/1973 | Wetherbee | 37/184 |
| 4,084,336 | 4/1978 | Mizutani et al. | 37/184 |
| 4,189,386 | 2/1980 | Aman | 37/461 |
| 4,502,407 | 3/1985 | Stevens | 294/66.2 |
| 4,526,413 | 7/1985 | Williams | 37/184 |
| 4,908,966 | 3/1990 | Phillips et al. | 37/185 |
| 5,199,194 | 4/1993 | Scott | 37/340 |
| 5,228,735 | 7/1993 | Morrow | 294/68.23 |
| 5,311,682 | 5/1994 | Sturdivant | 37/341 |

FOREIGN PATENT DOCUMENTS

| | | | |
|---|---|---|---|
| 582280 | 2/1994 | European Pat. Off. | 294/68.23 |

*Primary Examiner*—Spencer K. Warnick, IV

*Attorney, Agent, or Firm*—Gifford, Krass, Groh, Sprinkle, Patmore, Anderson & Citkowski, P.C.

[57] ABSTRACT

A bucket for power shovels is disclosed having a first bucket half and a second bucket half. Each bucket half includes a pair of spaced side walls and an end wall extending between the side walls which together forms a scoop for each bucket half. The bucket halves are pivotally secured together so that the scoops face each other and are movable between an open position in which the scoops are spaced apart from each other and a closed position in which the scoops space each other and form a load carrying chamber. The side walls of the bucket half overlap each other upon closure to minimize the spillage of the load out through the sides of the bucket during a scooping operation. Furthermore, a flap valve is mounted to an upper side of at least one of the bucket halves to allow water and air to freely escape from the interior chamber of the bucket as the bucket is lowered. This valve, however, prevents spillage of the load from the interior of the bucket.

17 Claims, 2 Drawing Sheets

POWER BUCKET

This is a continuation-in-part of application Ser. No. 08/245,240 filed on May 17, 1994 now U.S. Pat. No. 5,501,024.

BACKGROUND OF THE INVENTION

I. Field of the Invention

The present invention relates to a bucket for a power shovel.

II. Description of the Prior Art

There are many previously known buckets for power shovels of the type used for dredging, digging and the like. Many of these previously known buckets are known as "clam shell" buckets and consist of two bucket halves which are pivotally secured to each other. Each bucket half forms a scoop and, as the bucket halves pivot together, these scoops close together and form a load carrying chamber. The power shovel then moves the closed bucket with its load to the desired dumping site.

Power shovels with buckets are frequently used to remove hazardous waste and the like from the bottom of waterways. In such situations, it is desirable to remove a relatively shallow volume of earth from the bottom of the waterway since spills of hazardous material typically remain near the top of the soil.

There have been previously known buckets for power shovels, such as the bucket disclosed in my prior U.S. Pat. No. 5,029,923, which are designed to remove a relatively shallow amount of earth during a digging or trenching operation. One problem with these previously known buckets is that, as the bucket halves are moved from their open to their closed position, an amount of soil escapes from the sides of the bucket and between the bucket halves. Furthermore, the soil or earth which escapes in this fashion is frequently contaminated with hazardous waste since it represents only the outer portion of the removed soil. Consequently, overlapping trenching or digging is required in order to ensure removal of the hazardous waste.

In order to prevent the escape of the load from the bucket halves as the bucket is moved from its lowered to its raised position for dumping, it has been the previously known practice to form the bucket halves as substantially closed chambers. Consequently, with the bucket halves in their closed position and enclosing a load of contaminated soil, the closed bucket halves prevent the spillage of soil out from the top of the bucket.

One disadvantage of forming the bucket halves as closed chambers, however, is that, as the bucket is lowered into a waterway and toward the bottom of the waterway, the closed bucket halves displace water during the descent of the bucket. This displaced water creates water currents caused by the lowering of the bucket. Disadvantageously, these water currents tend to wash the soil away from the bottom of the bucket before the bucket reaches its lowered position. The soil that is washed away by the water currents, however, is oftentimes the most heavily contaminated with hazardous waste.

A still further disadvantage of these previously known buckets is that the wet soil to be moved from the bottom of the waterway tends to cling to the sides of the bucket even as the bucket is moved to its open position. This in turn increases the difficulty of cleaning the bucket and ensuring that all of the hazardous waste is removed from the bucket before the bucket is again lowered into the waterway.

SUMMARY OF THE PRESENT INVENTION

The present invention provides a power bucket which overcomes all of the above-mentioned disadvantages of the previously known devices.

In brief, the bucket of the present invention comprises a first bucket half and a second bucket half each having spaced side walls and end wall extending between the side walls. The side walls and end wall for each bucket half together form a scoop.

The bucket halves are pivotally mounted together so that the bucket halves are movable between an open position and a closed position. In an open position, the bucket halves are spaced apart from each other and face each other or downwardly. In their closed position, the bucket halves abuts against each other and form a substantially closed interior chamber. Furthermore, the side walls of the bucket preferably overlap when the bucket halves are closed in order to prevent side spillage out of the bucket halves.

At least one and preferably both bucket halves include an open mesh formed along an upper wall. A resilient flap is then secured along one edge of the mesh so that the flap overlies and covers the mesh.

In practice, as the open bucket is lowered into a waterway, the flap swings away from the wire mesh so that both air and water can escape through the mesh thus minimizing the creation of water currents caused by lowering the bucket together with the undesirable displacement of soil along the bottom of the waterway. Conversely, when the bucket is in its closed position and thus containing a load, the flaps close and prevent solid material from escaping through the mesh.

In order to facilitate emptying of the load from the bucket, at least one and preferably several pneumatic vibrators are provided along an outer surface of the bucket. These vibrators are selectively activated when the bucket is in its open position thus facilitating emptying of the bucket.

BRIEF DESCRIPTION OF THE DRAWINGS

A better understanding of the present invention will be had upon reference to the following detailed description when read in conjunction with the accompanying drawing wherein like reference characters refer to like parts throughout the several view, and in which.

DETAILED DESCRIPTION OF A PREFERRED EMBODIMENT OF THE INVENTION

Figure 1:
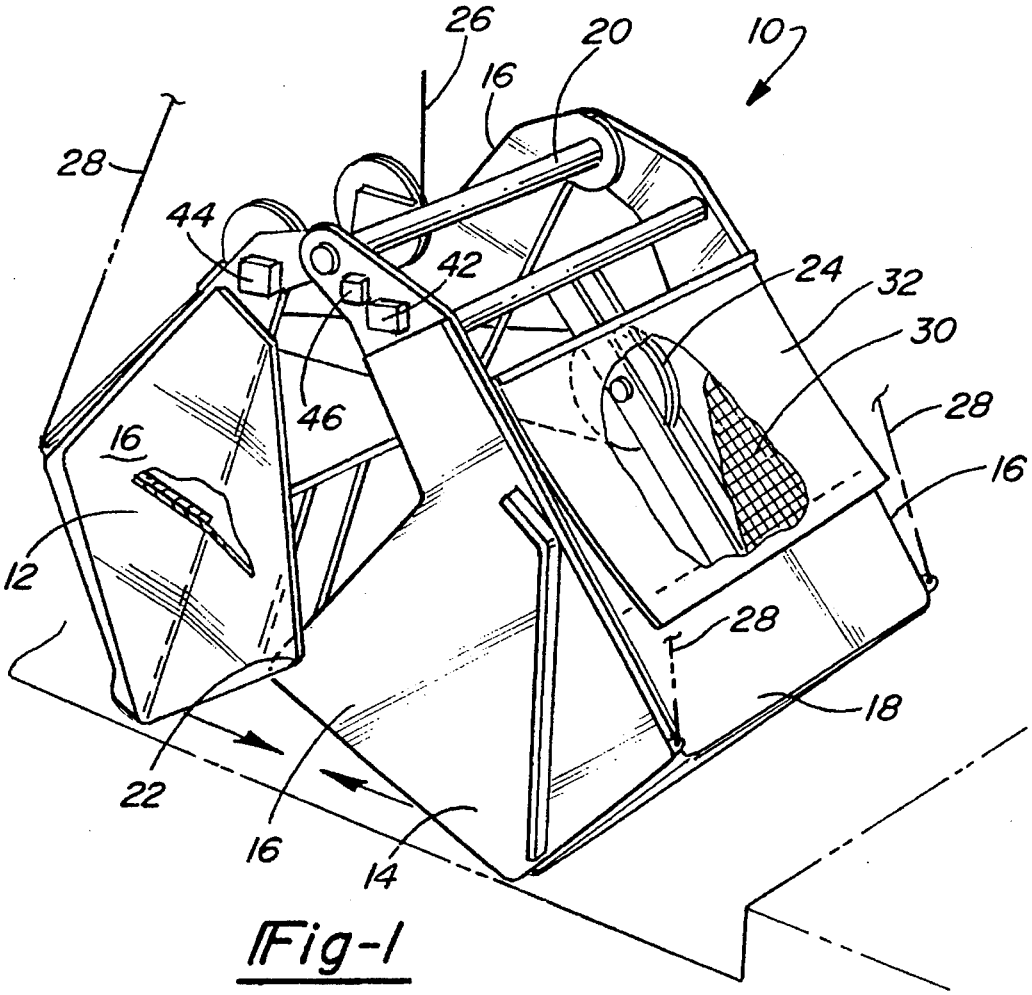
FIG. 1 is an elevational view illustrating a part embodiment of the present invention.
Figure 3:
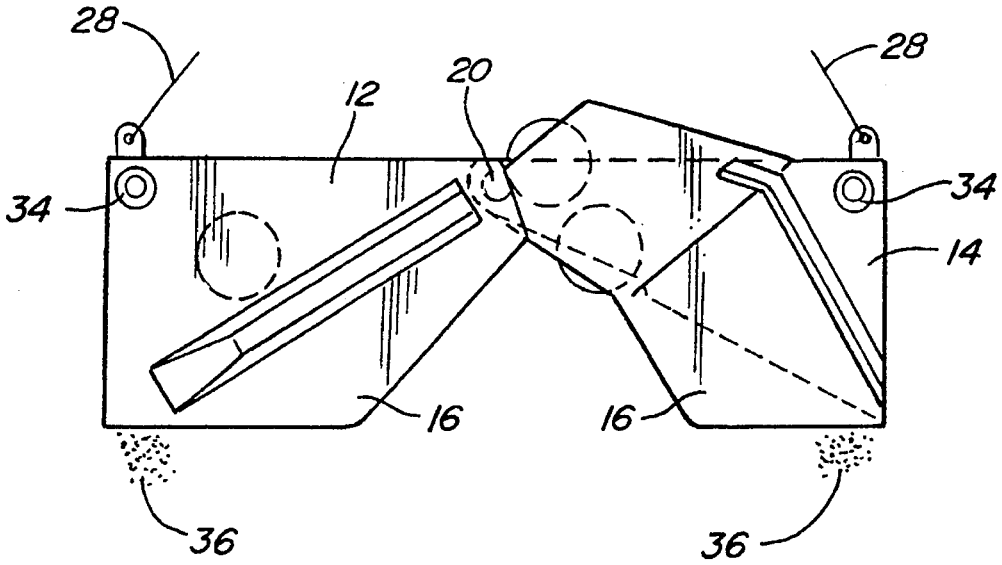
FIG. 3 is a side view illustrating the bucket in its open position.
Figure 2:
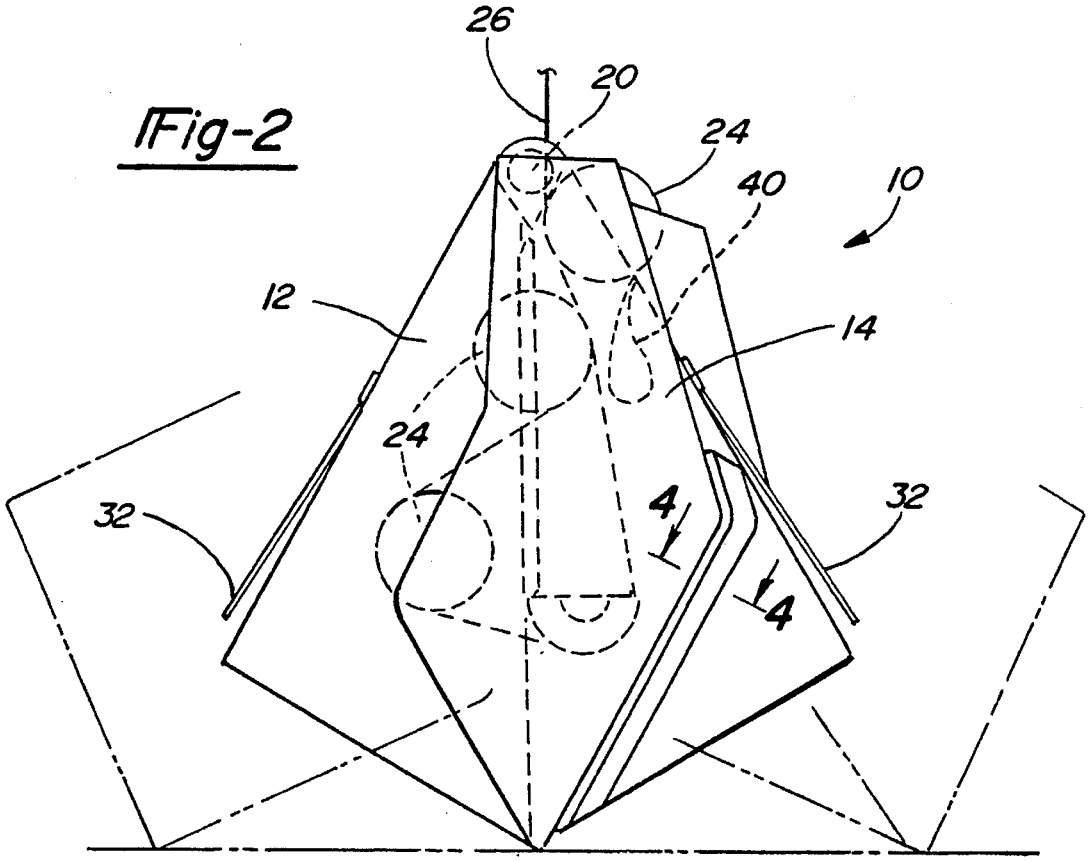
FIG. 2 is a side view illustrating the bucket in a closed position.

With reference first to FIGS. 1–3, a preferred embodiment of a power bucket 10 of the present invention is thereshown and comprises two bucket halves 12 and 14. Each bucket half 12 and 14 comprises a pair of spaced side walls 16 which are generally parallel to each other. An end wall 18 extends between the side wall 16 for each bucket half 12 and 14 so that each bucket half forms a scoop.

Figure 4:
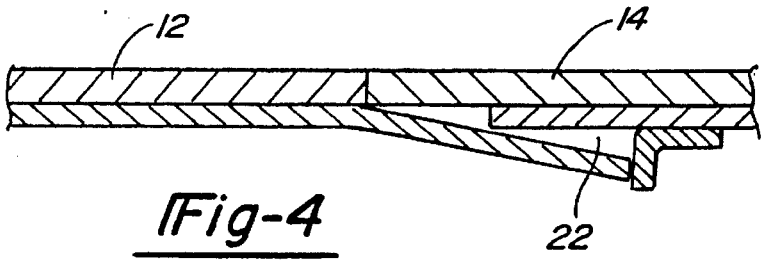
FIG. 4 is a view taken substantially along line 4—4 in FIG. 2 and enlarged for clarity.

Still referring to FIGS. 1–3, a pivot rod 20 pivotally secures the upper ends of the bucket halves 12 and 14 together. The bucket halves 12 and 14 are thus movable between an open position (FIG. 3) through a partially closed position (FIG. 1 ) and to a fully closed position (FIG. 2). In its fully open position (FIG. 3) the scoops formed by the bucket halves 12 and 14 are spaced from each other and face either towards each other or generally downwardly. As the bucket halves move to their partially closed position (FIG. 1 ) the side wall 16 on one bucket half 12 overlaps the side wall 16 on the other bucket half 14 as shown at 22. In doing so, the overlapping side walls 16 of the bucket halves 12 and 14 minimize spillage of the load out of the sides of the bucket as it is closed thus retaining the load in the load chamber formed by the bucket 10. FIG. 4 shows how the side walls meet to form a means for sealing.

With the bucket 10 in its fully closed position (FIG. 2) the bucket halves 12 and 14 are in abutment with each other thus forming an interior load chamber.

With reference now to FIG. 1, conventional pulleys 24 as well as a closure line 26 are provided for moving the bucket halves 12 and 14 between their open and closed position. The operation of the pulleys 24 and closure line 26 are conventional in construction so that a further description thereof is unnecessary. Similarly, the bucket halves 12 and 14 are preferably suspended from an elevated head (not shown) by suspension lines 28. This configuration enables the bucket 10 to achieve a "level cut" as illustrated diagrammatically in FIG. 2.

Figure 5:
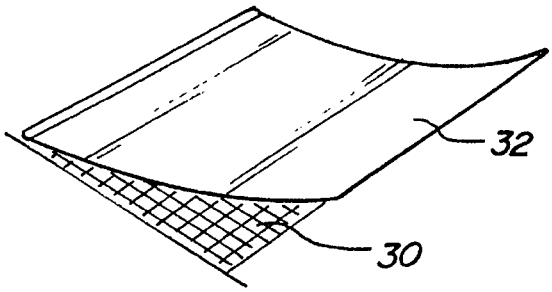
FIG. 5 is a fragmentary view illustrating a portion of the bucket of the present invention.

With reference now to FIGS. 1 and 5, in order to minimize the creation of water currents caused by lowering of the bucket 10 into a waterway, a metal mesh 30 is provided along an upper end of at least one, and preferably both bucket halves 12 and 14. A flap 32 constructed of a resilient material is then secured to the bucket half 14 along the upper edge of the mesh 16 so that the flap covers the mesh 30 as shown in FIG. 1.

In operation, with the bucket in its open position (FIG. 3) the bucket is lowered into a waterway. Air and water entrapped within the bucket, however, causes the flap 32 to swing away from the metal mesh 30 so that the air and water passes upwardly through the mesh 30. In doing so, the flap 32 and mesh minimizes the creation of water currents caused by lowering of the open bucket 10. Conversely, as the bucket is lifted with its load in its load chamber, the flap 32 closes against the mesh 30 and prevents the load contained within the load chamber of the bucket 10 from escaping out through the mesh 30. Consequently, the mesh 30 together with the flap 32 forms a valve which opens to allow air and water to escape through the valve, but which closes to prevent earth from escaping from the load chamber of the bucket 10.

With reference now to FIG. 3, at least one, and preferably several pneumatic vibrators 34 are secured to the bucket halves 12 and 14. With the bucket 10 in its open position (FIG. 3) activation of the vibrators 34 vibrate the bucket halves 12 and 14 thus shaking the soil 36 from the bucket 10 and facilitating the overall emptying of the bucket 10.

With reference now to FIG. 2, in the preferred embodiment of the invention, an air bag 40 is contained within the interior of the bucket chamber. The air bar 40 is selectively inflated when the bucket is in its closed position. Once inflated, the air bag 40 expands thus forcing water out through the metal mesh 30.

With reference now to FIG. 1, the bucket 10 of the present invention preferably includes a transducer module 42 mounted to one of the bucket halves 12 or 14. The transducer module 42 includes a conventional transducer for determining not only the depth of the bucket 10 when used in an underwater dredging operation, but also a depth sensor. The depth sensor provides an output signal to the operator of the distance between the bottom of the bucket 10 and the bottom of the waterway. The transducer module 42 thus enables the bucket operator to remove a carefully controlled depth of the waterway bottom.

Still referring to FIG. 1, the bucket can include a mount 44 for a television camera, if desired, as well as appropriate indicator switches 46 which provide a feedback signal to the bucket operator of the closure position of the bucket 10.

From the foregoing, it can be seen that the present invention provides an improved power bucket which is particularly designed for use in the removal of hazardous waste and the like from waterways. Having described my invention, however, many modifications thereto will become apparent to those skilled in the art to which it pertains without deviation from the spirit of the invention as defined by the scope of the appended claims.

I claim:

1. A bucket for a power shovel comprising:

a first bucket half and second bucket half, each bucket half having spaced sidewalls and an endwall extending between said sidewalls, said sidewalls and endwall for each bucket half forming a scoop, means for pivotally mounting said bucket halves together between an open position in which said scoops are spaced apart from each other and face each other and a closed position in which said endwalls abut each other and form a closed bottom for the bucket, at least one bucket half having an upper surface with an opening, valve means provided on said upper surface of said at least one bucket half for enabling air and water to exhaust from an interior of said scoops through said opening, said valve means being movable between an open position in which said valve means allows air to escape from said bucket halves through said opening and a closed position in which said valve means covers said opening and retains solid material within said interior of said scoops.

2. The invention as defined in claim 1 wherein said valve means comprises a rigid mesh and flap which overlies said mesh, said flap being movable between a closed position in which said flap is in abutment with said mesh and an open position in which said flap is spaced from said mesh.

3. The invention as defined in claim 2 wherein said flap is constructed of a resilient material.

4. The invention as defined in claim 3 wherein one edge of said flap is attached along one edge of said mesh.

5. The invention as defined in claim 1 and comprising said valve means on each bucket half.

6. The invention as defined in claim 1 and comprising means for selectively vibrating said bucket halves.

7. The invention as defined in claim 6 wherein said vibrating means comprises a pneumatic vibrator.

8. The invention as defined in claim 1 wherein one sidewalls on one of said bucket half overlaps the sidewalls on the other bucket half when said bucket halves are in said closed position.

9. The invention as defined in claim 8 wherein said sidewalls on said other bucket half taper inwardly towards each other.

10. The invention as defined in claim 9 and comprising means for sealing the sidewalls on one bucket half to the sidewalls of the other bucket when said bucket halves are in said closed position.

11. The invention as defined in claim 1 and comprising a selectively inflatable bag contained within the interior of said scoops.

12. The invention as described in claim 1 and comprising a transducer module mounted to the bucket for providing an output signal of the depth of the bucket in a waterway.

13. The invention as described in claim 1 and comprising means for mounting a television camera to the bucket.

14. A bucket for a power shovel comprising:

a first bucket half and a second bucket half, each bucket half having spaced sidewalls and an endwall extending between said sidewalls, said sidewalls and endwall for each bucket half forming a scoop, means for pivotally mounting said bucket halves together between an open position in which said scoops are spaced apart from each other and face each other and a closed position in which said endwalls abut each other and form a closed bottom for the bucket, valve means provided on an upper surface of at least one bucket half for enabling air and water to exhaust from an interior of said scoops, said valve means retaining solid material within said interior of said scoops, wherein said valve means comprises a rigid mesh and flap which overlies said mesh, said flap being movable between a closed position in which said flap is in abutment with said mesh and an open position in which said flap is spaced from said mesh.

15. The invention as defined in claim 14 wherein said flap is constructed of a resilient material.

16. The invention as defined in claim 15 wherein one edge of said flap is attached along one edge of said mesh.

17. A bucket for a power shovel comprising:

a first bucket half and a second bucket half, each bucket half having spaced sidewalls and an endwall extending between said sidewalls, said sidewalls and endwall for each bucket half forming a scoop, means for pivotally mounting said bucket halves together between an open position in which said scoops are spaced apart from each other and face each other and a closed position in which said endwalls abut each other and form a closed bottom for the bucket, valve means provided on an upper surface of at least one bucket half for enabling air and water to exhaust from an interior of said scoops, said valve means retaining solid material within said interior of said scoops, wherein one of said sidewalls on one of said bucket halves overlaps a sidewall on the other bucket half when said bucket halves are in said closed position, wherein said sidewalls on said other bucket half taper inwardly towards each other, and means for sealing the sidewalls on one bucket half to the sidewalls of the other bucket when said bucket halves are in said closed position.

* * * * *